US008689582B2

(12) United States Patent
Birkelund et al.

(10) Patent No.: US 8,689,582 B2
(45) Date of Patent: Apr. 8, 2014

(54) REFRIGERATION SYSTEM

(75) Inventors: Michael Birkelund, Middelfart (DK); Hans Kurt Petersen, Egtved (DK); Sune Prytz, Soenderborg (DK)

(73) Assignee: Danfoss A/S, Nordborg (DK)

( * ) Notice: Subject to any disclaimer, the term of this patent is extended or adjusted under 35 U.S.C. 154(b) by 966 days.

(21) Appl. No.: 12/664,797

(22) PCT Filed: Jun. 17, 2008

(86) PCT No.: PCT/DK2008/000223

§ 371 (c)(1),
(2), (4) Date: Jun. 16, 2010

(87) PCT Pub. No.: WO2008/154923

PCT Pub. Date: Dec. 24, 2008

(65) Prior Publication Data

US 2010/0281913 A1 Nov. 11, 2010

(30) Foreign Application Priority Data

Jun. 19, 2007 (DE) ..... 10 2007 028 565

(51) Int. Cl.
*F25B 39/02* (2006.01)

(52) U.S. Cl.
USPC ..... 62/525; 62/524

(58) Field of Classification Search
USPC ..... 62/524, 525, 527, 528; 137/625.11, 137/625.12, 625.16
See application file for complete search history.

(56) References Cited

U.S. PATENT DOCUMENTS

| | | | | | |
|---|---|---|---|---|---|
| 247,755 | A | * | 10/1881 | Fyfe | 137/565.25 |
| 1,625,198 | A | * | 4/1927 | Eisenhauer | 210/88 |
| 1,842,382 | A | * | 1/1932 | Arey | 137/625.11 |
| 2,102,870 | A | * | 12/1937 | Witzel | 62/525 |
| 2,144,898 | A | | 1/1939 | Shrode | |
| 2,283,386 | A | * | 5/1942 | Newton | 62/157 |
| 2,335,085 | A | * | 11/1943 | Roberts | 137/625.11 |
| 2,700,395 | A | * | 1/1955 | Young | 137/523 |
| 3,095,889 | A | * | 7/1963 | Barroll et al. | 137/14 |
| 3,763,891 | A | * | 10/1973 | Stiltner | 137/625.18 |
| 4,178,963 | A | * | 12/1979 | Riefler et al. | 137/624.18 |
| 4,305,417 | A | * | 12/1981 | Bell, Jr. | 137/119.03 |
| 4,345,228 | A | * | 8/1982 | Idogaki et al. | 335/222 |
| 4,505,297 | A | * | 3/1985 | Leech et al. | 137/561 A |
| 5,361,796 | A | * | 11/1994 | Mutter | 137/14 |

(Continued)

FOREIGN PATENT DOCUMENTS

| | | | |
|---|---|---|---|
| CA | 1136874 | A2 | 12/1982 |
| DE | 174075 | A | 12/1905 |

(Continued)

OTHER PUBLICATIONS

International Search Report for PCT/DK2008/000223 dated Sep. 24, 2008.

*Primary Examiner* — Ljiljana Ciric
*Assistant Examiner* — Alexis Cox
(74) *Attorney, Agent, or Firm* — McCormick, Paulding & Huber LLP

(57) ABSTRACT

A refrigeration system includes a refrigerant circuit with a plurality of evaporator paths and a distributor for distributing refrigerant. The distributor includes a housing and a controllable valve for each evaporator path. The refrigeration system is operated by using a distributor including a magnet arrangement for controlling the valves.

10 Claims, 3 Drawing Sheets

(56) References Cited

U.S. PATENT DOCUMENTS

| | | | | |
|---|---|---|---|---|
| 5,704,221 | A | 1/1998 | Lego | |
| 5,832,744 | A | 11/1998 | Dorste et al. | |
| 8,191,384 | B2 * | 6/2012 | Funder-Kristensen et al. | 62/504 |
| 2001/0045235 | A1 * | 11/2001 | Schick | 137/625.11 |
| 2006/0070671 | A1 * | 4/2006 | Kasai et al. | 137/625.46 |
| 2010/0307190 | A1 * | 12/2010 | Petersen et al. | 62/498 |

FOREIGN PATENT DOCUMENTS

| | | | |
|---|---|---|---|
| DE | 19547744 | A1 | 6/1997 |
| EP | 0091006 | A2 | 10/1983 |
| JP | 55039419 | A | 3/1980 |
| JP | 1010061 | A | 1/1989 |
| JP | 8068575 | A | 3/1996 |
| JP | 2001325651 | A | 11/2001 |

* cited by examiner

REFRIGERATION SYSTEM

CROSS REFERENCE TO RELATED APPLICATIONS

This application is entitled to the benefit of and incorporates by reference essential subject matter disclosed in International Patent Application No. PCT/DK2008/000223 filed on Jun. 17, 2008 and German Patent Application No. 10 2007 028 565.7 filed Jun. 19, 2007.

FIELD OF THE INVENTION

The invention concerns a refrigeration system with a refrigerant circuit comprising several evaporation paths and a distributor causing a distribution of refrigerant, the distributor comprising a housing and a controllable valve for each evaporation path.

BACKGROUND OF THE INVENTION

Such a refrigeration system is known from DE 195 47 744 A1. The known refrigeration system comprises one single compressor and one single condenser, but two evaporators, which are made separately from one another. The refrigerant flow delivered by the compressor is divided into two partial flows after the condenser and before the expansion valves by means of a 3/2-way valve, whose position is controlled by a control unit. This embodiment, however, only permits dividing the refrigerant flow into two evaporator paths.

To permit the supply of several evaporator paths, U.S. Pat. No. 5,832,744 discloses a refrigeration system, in which the distributor comprises a valve between one refrigerant inlet and several refrigerant outlets, said valve being connected in series to a rotating turbine blade. The turbine blade is provided to ensure that the refrigerant is distributed evenly to all outlets of the distributor and thus also evenly to all evaporators. In theory, such a distributor ensures an even distribution of the refrigerant to the individual evaporators. However, already small differences in the dimensions, which could, for example, occur during manufacturing, cause an uneven distribution of the refrigerant to the individual evaporators. Further, with such distributors, it is necessary that basically the individual distributors have the same thermal load and also the same flow resistance. If this is not the case, it may happen that one evaporator receives too much refrigerant, so that the refrigerant is not completely evaporated when it has passed the evaporator. Another evaporator, which is connected to the same distributor can receive too little refrigerant, so that the evaporator cannot deliver the desired refrigeration performance. The oversupply or the undersupply of the evaporator can in particular cause problems, if temperature sensors, which are located at the evaporators or in other positions in the refrigeration system, are controlling an expansion valve. Under unfavourable circumstances, the expansion valve will be caused to vibrate naturally, which further deteriorates the capacity and the efficiency of the refrigeration system.

SUMMARY OF THE INVENTION

The invention is based on the task of achieving a predetermined operation of the refrigeration system with simple means.

With a refrigeration system as mentioned in the introduction, this task is solved in that the distributor comprises a magnet arrangement controlling the valves.

When, in the following, the term "refrigeration system" is used, the term must be interpreted broadly. It comprises in particular refrigeration systems, freezing systems, air-conditioning systems and heat pumps, that is, all systems in which a refrigerant is circulated or circulates. The term "refrigeration system" is merely used for simplification purposes. The evaporator paths can be arranged in different evaporators. For reasons of simplicity the invention is explained in connection with several evaporators. However, the invention can also be used, when one evaporator comprises several evaporator paths, which are controlled individually or in groups.

When the distributor comprises a controllable valve for each evaporator, it can control the supply of the evaporators individually, that is, it is then possible to supply each evaporator with the amount of refrigerant it requires. It no longer has to be ensured that all evaporators have the same flow resistance. It is also von inferior importance, if the evaporators have to supply different cooling outputs. An evaporator, from which a larger cooling output is required, receives correspondingly more refrigerant that an evaporator, which has to supply a smaller cooling output. In a simple manner, the control of the valves occurs by means of a magnet arrangement comprising at least one magnet. A magnet exerts magnet forces on valves or parts of valves, if the magnet is in the vicinity of the valve and is active. If, on the other hand, the magnet is far away from the valve or is passive, for example a disconnected electric magnet, it exerts no forces on this valve or parts of it. Thus, by means of a control of the position and/or the function of the magnet, it can be ensured that a certain valve is opened, while other valves remain closed.

Preferably, the magnet arrangement comprises a rotor that carries at least one magnet. As the magnet is arranged on the rotor, a rotational movement of the rotor will displace the magnet from one valve to another. The rotational movement of the rotor can be controlled by a control arrangement. Thus, eventually, the control arrangement is responsible for the distribution of the refrigerant to the individual evaporators.

It is also advantageous that the magnet arrangement comprises at least one magnet in the form of an electric magnet. In this case, the magnet can be turned on or off.

Preferably, the magnet acts through a closed wall of the housing. This has the advantage that an activation of the valves does not require an opening for the entry of a tappet or the like. If such an opening is not present, also the problem of a possible leakage does not occur. The only condition for such an embodiment is that the wall does not hinder the effect of the magnet. A plastic material, for example, permits a practically undisturbed passage of a magnetic field. The same also applies for many non-magnetic metals.

Preferably, the magnet is guided in a circumferential groove. Thus, the groove defines a circular path, in which the magnet can move. Thus, it is sufficient to fix the magnet to the rotor in the circumferential direction. The circumferential groove ensures that in the radial direction the magnet will always maintain the correct positioning in relation to the valves.

Preferably, the valve is made as a pilot-controlled valve. The forces that a magnet can provide are, among other things, dependent on the size of the magnet. The size of the magnet is determined by the size of the distributor. Usually, it is endeavoured not to make the distributor too large. Accordingly, also the forces that the magnet can provide are limited. If a pilot-controlled valve is used, the magnet only has to act upon an auxiliary element, which then uses an auxiliary energy, for example the pressure of the refrigerant, to activate a main valve element.

It is preferred that the valve comprises an auxiliary valve element to be moved by the magnet and a main valve element to be moved by the refrigerant, interacting with a main valve seat and bordering, with its side facing away from the main valve seat, a pressure chamber, the auxiliary valve element blocking or releasing a passage from the pressure chamber to an outlet opening connected to an evaporation path. When the auxiliary valve element is displaced by the magnet, the passage is released so that the pressure in the pressure chamber drops. The dropping pressure can then be used to lift the main valve element from the main valve seat. The main valve element then remains lifted from the valve seat until the auxiliary valve element blocks the passage again. Then, the pressure in the pressure chamber can build up again to a level that moves the main valve element back to the main valve seat. The auxiliary valve element blocks the passage, when the magnet is rotated further, so that it can no longer act upon the corresponding auxiliary valve element.

Preferably, a throttle path extends from an inlet of the distributor to the pressure chamber in parallel to the main valve element. Through the throttle path refrigerant can get from the inlet to the pressure chamber. The pressure then ruling in the pressure chamber ensures that the main valve element bears on the main valve seat as long as the auxiliary valve element has not released the passage. Not until the auxiliary valve element has released the passage, the pressure in the pressure chamber drops so much that the main valve element can open. When the passage is released, the throttle path can namely not supply sufficient refrigerant to generate the pressure required to close the valve.

Preferably, the throttle path extends between the main valve element and a guide for the main valve element. Thus, not only the pressure difference over the main valve can be utilised to lift the main valve element from the main valve seat. Also the flow of refrigerant through the throttle path is utilised. The refrigerant then generates some kind of "friction" on the main valve element, so that the main valve element can also be lifted from the main valve seat, when the pressure application surfaces on the main valve element for the refrigerant would not permit a movement of the main valve element merely because of a pressure difference. In this case, the throttle path can simply be formed in that a small play exists between the main valve element and the guide. Of course one or more corresponding grooves can also be formed in the circumferential wall of the main valve element or in the inner wall of the guide to form the throttle path.

Preferably, a first pressure drop over the throttle path is larger than a second pressure drop between the pressure chamber and the outlet. This embodiment ensures that the main valve element opens reliable and also remains open as long as the auxiliary valve element releases the passage. As long as the auxiliary valve element does not block the passage, the refrigerant flow into the pressure chamber will not be sufficient to bring the main valve element back to rest on the main valve seat.

Preferably, the auxiliary valve element interacts with a closing spring. The closing spring does not have to provide large forces. It must merely be able to bring the auxiliary valve element to rest on an auxiliary valve seat. When the distributor is mounted so that the auxiliary valve element will come to rest on the auxiliary valve seat under the effect of the gravity, a closing spring may be avoidable. However, with a closing spring the advantage exists that choice of the mounting position is substantially free.

Preferably, the magnet arrangement has a controllable magnet with which several valves can be controlled at the same time. A controllable magnet can, for example, be an electric magnet, that is, a magnetic coil that can be supplied with electrical current to activate the magnet. When the current is turned off, the magnet will no longer be active. If a magnet is located so that it can control several or even all valves of the distributor at the same time, all valves can be opened when starting the refrigeration system to reduce the temperature in the refrigeration system quickly. After a suitable filling of the evaporator paths, the controllable magnet is turned off and the further control is, for example made by means of the rotor.

It is also preferred that each valve is provided with its own controllable magnet. Also such a magnet can be an electric magnet. This embodiment has the advantage that the valves can be controlled independently of one another, that is, also in a more or less random order. Also here all valves can be opened simultaneously when starting the refrigeration system.

BRIEF DESCRIPTION OF THE DRAWINGS

In the following, the invention is explained on the basis of a preferred embodiment as shown in the drawings.

DETAILED DESCRIPTION OF THE PREFERRED EMBODIMENTS

Figure 1:
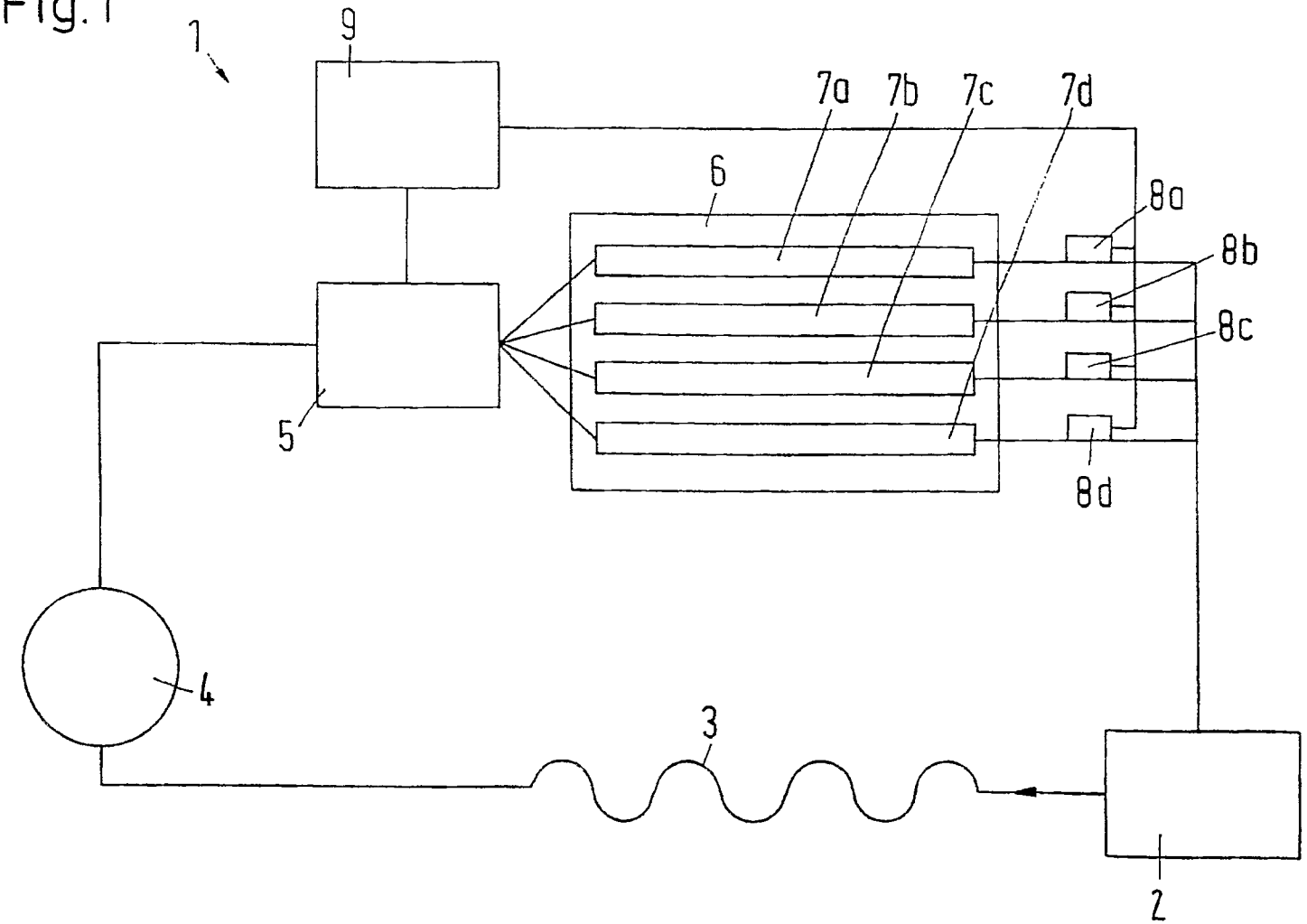
FIG. 1 is a schematic view of a refrigeration system with several evaporators.

FIG. 1 shows a schematic view of a refrigeration system 1, in which a compressor 2, a condenser 3, a collector 4, a distributor 5 and an evaporator arrangement 6 with several parallel-connected evaporators 7*a*-7*d* are joined to a circuit. The evaporator arrangement 6 can also have one single evaporator comprising several evaporator paths, which can be controlled individually or in groups.

In a manner known per se, liquid refrigerant evaporates in the evaporators 7*a*-7*d*, is compressed by the compressor 2, liquefied in the condenser 3 and collected in the collector 4. The distributor 5 is provided to distribute the liquid refrigerant to the individual evaporators 7*a*-7*d*.

At the outlet of each evaporator 7*a*-7*d* a temperature sensor 8*a*-8*d* is arranged. The temperature sensors 8*a*-8*d* determine the temperature of the refrigerant leaving the evaporators 7*a*-7*d*. This temperature information is passed on to a control unit 9 that controls the distributors in dependence of the temperature signals of the temperature sensors 8*a*-8*d*.

The FIGS. 2 to 6 show the distributor 5 with further details.

Figure 2:
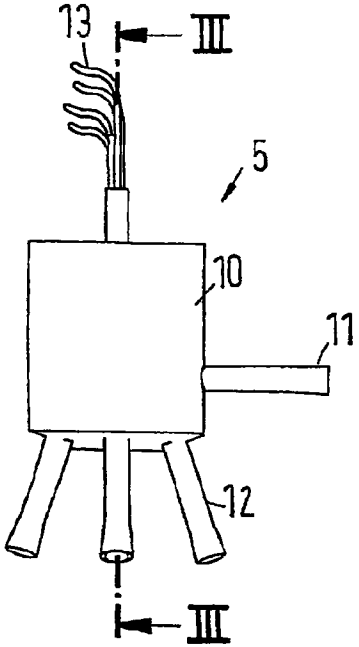
FIG. 2 is a side view of a distributor.

FIG. 2 shows that the distributor 5 comprises a housing 10 with an inlet 11 and several outlets 12, each outlet 12 being connected to an evaporation path 7*a*-7*d*. The signals from the temperature sensors 8*a*-8*d* are supplied to the distributor 5 via electrical lines 13.

Figure 4:
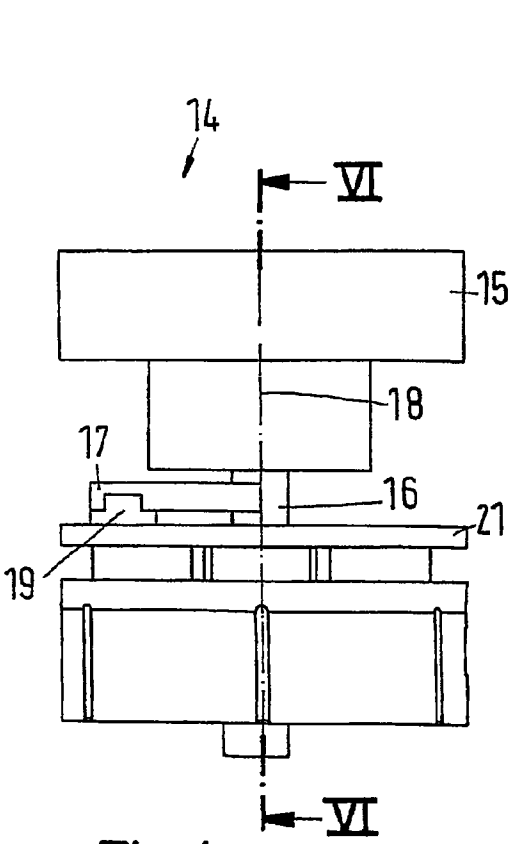
FIG. 4 is a side view of an insert.
Figure 3:
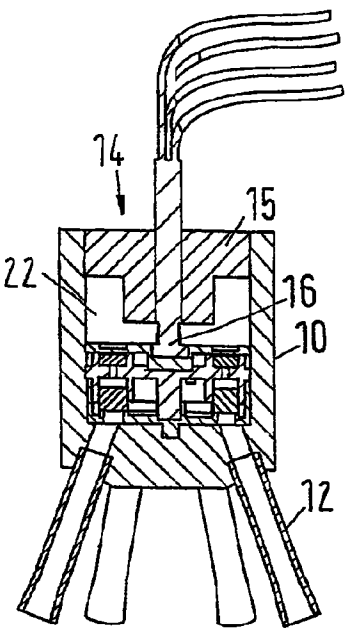
FIG. 3 is a section III-III according to FIG. 2.
Figure 5:
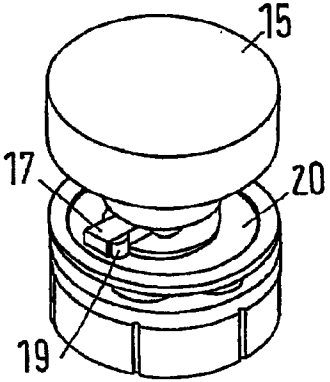
FIG. 5 is a perspective view of the insert.
Figure 6:
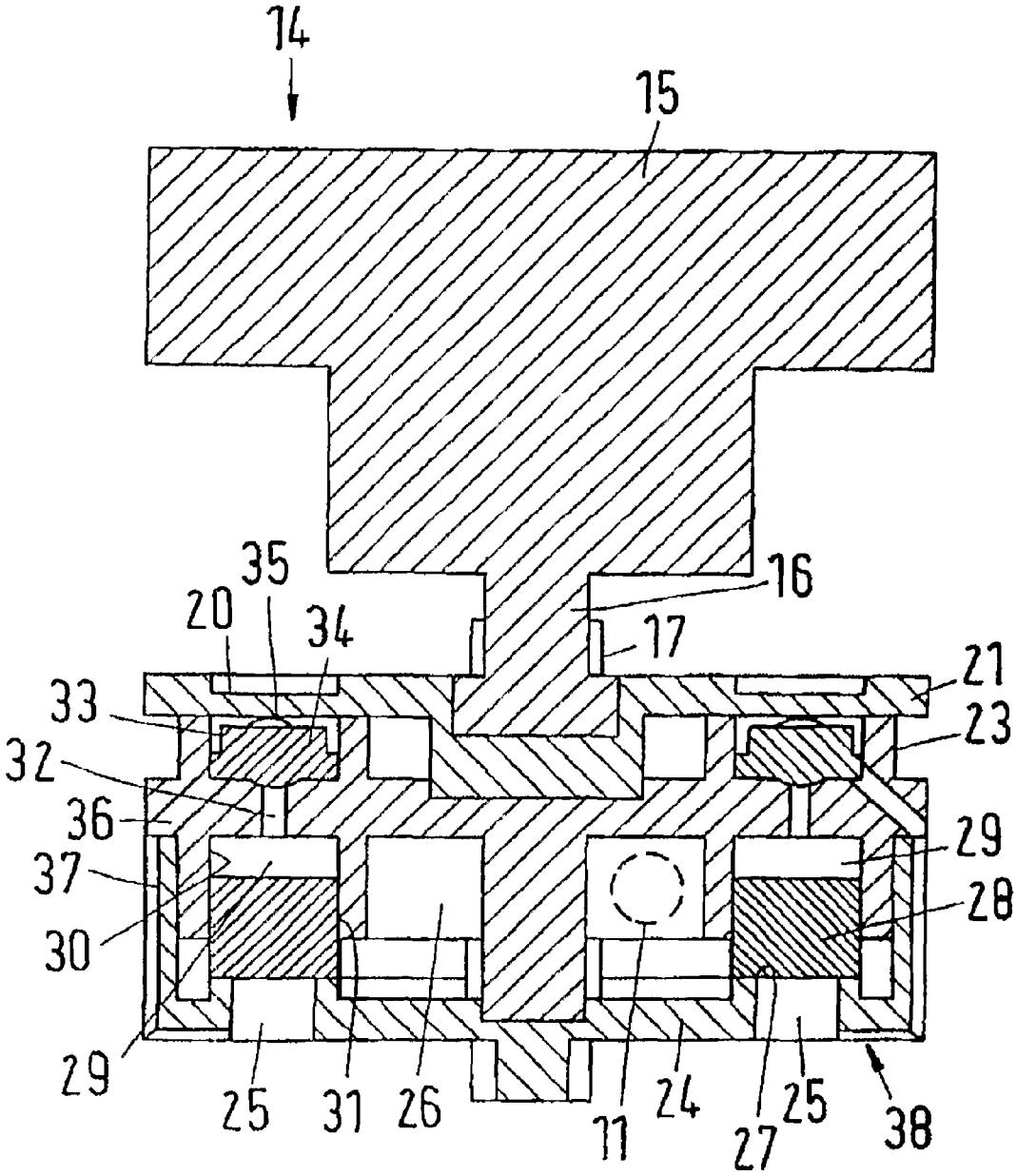
FIG. 6 is a section VI-VI according to FIG. 4.

As can be seen from FIG. 3, the housing 10 of the distributor 5 is provided with an insert 14 that is shown with further details in the FIGS. 4 to 6. The insert 14 comprises a motor 15, a rotor 17 being fixed on the drive shaft 16 of said motor 15. When the motor rotates the drive shaft 16, the rotor 17 is swivelled around a rotation axis 18. In this case, the rotor 17 has the form of an arm that is connected to the drive shaft 16. The motor 15 can, for example, be a step motor.

At the end facing away from the drive shaft 16, the rotor carries a magnet 19 that is guided in a circumferential groove 20 when the rotor 17 is rotating. The circumferential groove 20 is formed in a cover wall 21 that seals a part of the inner chamber 22 of the housing 10 that lies next to the outlets 12. Further, the motor 15 can, for example be pressed into the housing, if no other options are used to hold the motor 15 unrotatably in the housing 10.

In the embodiment shown, the magnet 19 is expediently a permanent magnet. The magnet 19 can, however, also be an electric magnet, which can, in a manner of speaking, be turned on and off.

On the side of the cover wall 21 facing away from the motor 15, an insert housing 23 is arranged, whose side facing away from the cover wall 21 is covered by a bottom plate 24. An outlet opening 25 for each outlet 12 is provided in the bottom plate 24.

Together with the bottom plate 24 the insert housing 23 borders an inlet chamber 26 for refrigerant. The inlet 11 is shown schematically here to ease the understanding.

On the side facing the cover wall 21, each outlet opening 25 forms a main valve seat 27. A main valve element 28 interacts with each main valve seat 27. On the side facing away from the valve seat 27 the main valve element 28 borders a pressure chamber 29 together with a guide 30 that surrounds the main valve element 28 in the circumferential direction.

However, the main valve element 28 is guided in the guide 30 with a small play, so that a throttle path 31 occurs through which refrigerant can flow from the inlet chamber 26 to the pressure chamber 29, also when the main valve element 28 bears on the main valve seat 27.

From the pressure chamber 29 an auxiliary channel 32 leads into an auxiliary chamber 33, in which an auxiliary valve element 34 is located. The auxiliary valve element 34 is positioned in such a way by the force of a closing spring 35 that can be made to be relatively weak that it closes the auxiliary channel 32. In the shown, closed position of the auxiliary valve element 35, refrigerant that has reached the pressure chamber 29 cannot flow off from the pressure chamber 29.

If, however, the magnet 19 is positioned over the auxiliary valve element 34, the magnet 19 attracts the auxiliary valve element 34 against the force of the closing spring 35, so that the auxiliary channel 32 is released and a connection occurs between the pressure chamber 29 and the auxiliary chamber 33. The refrigerant that was previously trapped in the pressure chamber 29 can then flow into the auxiliary chamber 33 and from there through further auxiliary channel sections 36, 37 to the outlet opening 25. This reduces the pressure in the pressure chamber 29.

The refrigerant from the inlet chamber 26 subsequently flowing into the pressure chamber 29 through the throttle path 31 then generates a pressure difference over the main valve element 28 that is sufficient to lift the main valve element 28 from the main valve seat 27. As soon as the main valve element 28 has been lifted from the main valve seat 27, the full pressure of the refrigerant from the inlet chamber 26 acts in the opening direction upon the main valve element 28, so that it is maintained in the opening position. As long as the main valve element 28 is lifted from the main valve seat 27, refrigerant flows via the corresponding outlet opening 25 into the outlet 12 and then into the allocated evaporator path 7*a*-7*d*.

When the magnet 19 is rotated further, so that it no longer acts upon the auxiliary valve element 34, the closing spring 35 again presses the auxiliary valve 34 back to the closed position shown, so that the auxiliary channel 32 is closed. As refrigerant still reaches the pressure chamber 29 through the throttle path 32, which can, however, no longer flow off through the auxiliary channel 32 and the auxiliary channel sections 36, 37, a pressure builds up in the pressure chamber 29 that does again make the main valve element 28 rest on the main valve seat 27. The main valve element 28, the valve seat 27 and the auxiliary valve element 34 thus form essential parts of a valve 38, a valve being provided for each outlet opening 25 and thus for each evaporator path 7*a*-7*d*, each valve 38 being individually controllable. The amount of refrigerant that will then reach the individual evaporator paths 7*a*-7*d* depends on the duration of the period, during which the magnet 19 remains over the individual auxiliary valve elements 34. During a rotation of the drive shaft 16, each valve 38 will thus open once. If, under certain circumstances, it is desired to prevent the opening of a valve 38, the rotation direction of the drive shaft 16 is reversed before reaching the valve 38 in question, or the magnet is made to pass very quickly over the corresponding auxiliary valve element 34. When using an electric magnet, the magnet 19 can be turned off when passing a valve 38 that shall not be opened.

The throttle path 31 has a flow resistance that is larger than the flow resistance of the auxiliary channel 32 and the auxiliary channel sections 36, 37. Accordingly, no pressure can build up in the pressure chamber 29, as long as the auxiliary valve element 34 releases the auxiliary channel 32.

It is shown that the control arrangement 9 is located separately from the distributor 5. However, it is also possible to make a design that joins the control arrangement 9 and the distributor 5.

In a manner not shown in detail, an additional magnet coil can be arranged so that its magnetic field can act upon all auxiliary valve elements 34 at the same time. In this case, all valves 38 are opened at the same time. This is advantageous when starting the refrigeration system 1, in order to lower the temperature quickly. After a suitable filling of the evaporator paths, the coil is turned off and the rotor rotates the magnet 19 to the various auxiliary elements 34. However, it can also be provided that the effect of such an electric magnet is limited to some or several valves 38.

In an embodiment that is also not shown in detail, the rotor bringing the magnet 19 from one valve 38 to the next can be replaced by providing an electric magnet for each valve 38, which then opens the valve 38 individually. All electric magnets are then connected to the control arrangement 9 that controls the valves 38.

While the present invention has been illustrated and described with respect to a particular embodiment thereof, it should be appreciated by those of ordinary skill in the art that various modifications to this invention may be made without departing from the spirit and scope of the present.

What is claimed is:

1. A refrigeration system with a refrigerant circuit comprising:

a plurality of evaporation paths;

a distributor causing a distribution of refrigerant, the distributor comprising a plurality of controllable valves and a housing, each of the plurality of controllable valves corresponding to one of the plurality of evaporation paths;

wherein the distributor comprises a magnet arrangement controlling the plurality of controllable valves, the magnet arrangement comprising a rotor that carries at least one magnet;

wherein each of the plurality of controllable valves is a pilot-controlled valve comprising:

a corresponding auxiliary valve element that is moved by the at least one magnet, the auxiliary valve element blocking or releasing a passage from a pressure chamber to an outlet opening connected to at least one of the plurality of evaporation paths; and a corresponding main valve element that is moved by the refrigerant and interacts with a main valve seat, a side of the main valve element, which faces away from the main valve seat, bordering the pressure chamber.

2. The refrigeration system according to claim 1, wherein the at least one magnet is an electromagnet.

3. The refrigeration system according to claim 1, wherein the at least one magnet acts through a closed wall of the housing.

4. The refrigeration system according to claim 1, wherein the at least one magnet is guided in a circumferential groove in the housing.

5. The refrigeration system according to claim 1, wherein a throttle path extends from an inlet of the distributor to the pressure chamber in parallel to the corresponding main valve element.

6. The refrigeration system according to claim 5, wherein the throttle path extends between the corresponding main valve element and a guide for the corresponding main valve element.

7. The refrigeration system according to claim 5, wherein a first pressure drop over the throttle path is larger than a second pressure drop between the pressure chamber and the outlet opening.

8. A refrigeration system with a refrigerant circuit comprising;

a plurality of evaporation paths; and a distributor causing a distribution of refrigerant, the distributor comprising a plurality of controllable valves and a housing, each of the plurality of controllable valves corresponding to one of the plurality of evaporation paths;

wherein the distributor comprises a magnet arrangement controlling the plurality of controllable valves;

wherein each of the plurality of controllable valves is a pilot-controlled valve comprising:

a corresponding auxiliary valve element that is moved by the at least one magnet, the auxiliary valve element blocking or releasing a passage from a pressure chamber to an outlet opening connected to at least one of the plurality of evaporation paths; and a corresponding main valve element that is moved by the refrigerant and interacts with a main valve seat, a side of the main valve element, which faces away from the main valve seat, bordering the pressure chamber.

9. A refrigeration system with a refrigerant circuit comprising:

a plurality of evaporation paths; and a distributor causing a distribution of refrigerant, the distributor comprising a plurality of controllable valves and a housing, each of the plurality of controllable valves corresponding to one of the plurality of evaporation paths;

wherein the distributor comprises a magnet arrangement controlling the plurality of controllable valves, the magnet arrangement comprising a rotor that carries at least one magnet; and wherein the at least one magnet is a controllable magnet with which several valves can be controlled at the same time.

10. A refrigeration system with a refrigerant circuit comprising:

a plurality of evaporation paths; and a distributor causing a distribution of refrigerant, the distributor comprising a plurality of controllable valves and a housing, each of the plurality of controllable valves corresponding to one of the plurality of evaporation paths;

wherein the distributor comprises a magnet arrangement controlling the plurality of controllable valves, the magnet arrangement comprising a rotor that carries at least one magnet; and wherein each of the plurality of controllable valves is provided with its own controllable magnet.

* * * * *